US011027164B2

(12) United States Patent
Wang

(10) Patent No.: US 11,027,164 B2
(45) Date of Patent: Jun. 8, 2021

(54) EASY-TO-ASSEMBLE TRAMPOLINE

(71) Applicant: Yongqi Wang, Dongguan (CN)

(72) Inventor: Yongqi Wang, Dongguan (CN)

( * ) Notice: Subject to any disclaimer, the term of this patent is extended or adjusted under 35 U.S.C. 154(b) by 0 days.

(21) Appl. No.: 16/511,781

(22) Filed: Jul. 15, 2019

(65) Prior Publication Data

US 2020/0206554 A1 Jul. 2, 2020

(30) Foreign Application Priority Data

Dec. 29, 2018 (CN) ..... 201811641952.6
Dec. 29, 2018 (CN) ..... 201811642004.4
Dec. 29, 2018 (CN) ..... 201811646661.6
Dec. 29, 2018 (CN) ..... 201822277976.X

(51) Int. Cl.
*A63B 5/11* (2006.01)
*A63B 71/00* (2006.01)

(52) U.S. Cl.
CPC ..... *A63B 5/11* (2013.01); *A63B 71/0054* (2013.01); *A63B 2210/50* (2013.01)

(58) Field of Classification Search
CPC ..... A63B 71/02; A63B 71/021; A63B 71/022; A63B 71/023; A63B 71/028; A63B 71/0054; A63B 2071/024; A63B 2071/025; A63B 2071/026; A63B 2071/027; A63B 2071/009; A63B 2225/09; A63B 2225/093; A63B 21/00189; A63B 21/026; A63B 5/08; A63B 5/11
USPC ..... 24/8, 11 R, 268
See application file for complete search history.

(56) References Cited

U.S. PATENT DOCUMENTS 6,663,538 B2 * 12/2003 Yoon ..... A63B 5/11 482/27
7,708,667 B2 5/2010 Alexander
8,105,211 B2 1/2012 Alexander
(Continued)

FOREIGN PATENT DOCUMENTS

AU 2014100789 B4 8/2014
CA 2527745 A1 * 12/2004 ..... A63B 71/0054
(Continued)

OTHER PUBLICATIONS

American Elements, Aluminum Spring [online], Published Feb. 2, 2018, Retrieved from the Internet <URL: https://www.americanelements.com/aluminum-spring-7429-90-5>. (Year: 2018).*

*Primary Examiner* — Garrett K Atkinson
*Assistant Examiner* — Zachary T Moore

(57) ABSTRACT

The present invention discloses an easy-to-assemble trampoline, which includes a flexible mat, a frame, and a plurality of flexible rods, its top of the flexible rods are arranged at its periphery or its bottom of the flexible mat, and its bottom end of flexible rods are retained on the frame. The top end of the flexible rods are fixedly mounted at the periphery or bottom of the flexible mat by a buckle structure; the buckle structure includes a mounting member, a flexible belt and at least one clamping member; one end of the belt is fixed on the flexible mat, the clamping member is fixed on the belt, and the mounting member is provided with a through hole; the belt can pass through the through hole, and the clamping member holds the belt at its outlet of the through hole.

18 Claims, 10 Drawing Sheets

(56) References Cited

U.S. PATENT DOCUMENTS

| | | | | |
|---|---|---|---|---|
| 8,137,242 | B2 * | 3/2012 | VanElverdinghe | A63B 5/11 482/27 |
| 8,303,469 | B2 | 12/2012 | Alexander | |
| 9,089,732 | B2 | 7/2015 | Andon et al. | |
| 9,486,658 | B2 | 12/2016 | Alexander | |
| 9,492,698 | B2 | 12/2016 | Andon et al. | |
| 9,643,039 | B2 * | 5/2017 | Andon | A63B 71/022 |
| 9,656,110 | B2 | 5/2017 | Alexander | |
| 10,124,199 | B2 * | 11/2018 | Andon | A63B 5/11 |
| 2004/0171461 | A1 * | 9/2004 | Alexander | A63B 5/11 482/27 |
| 2008/0269020 | A1 * | 10/2008 | Alexander | A63B 5/11 482/29 |
| 2015/0045188 | A1 * | 2/2015 | Allen | A63B 71/022 482/27 |
| 2017/0203174 | A1 * | 7/2017 | Chen | A63B 71/022 |
| 2019/0060692 | A1 * | 2/2019 | Chang | A44B 19/30 |

FOREIGN PATENT DOCUMENTS

| | | | | |
|---|---|---|---|---|
| CN | 201380072581.3 | A | 7/2016 | |
| CN | 201710258397.8 | A | 8/2017 | |
| EP | 3417916 | A1 * | 12/2018 | A63B 71/022 |

* cited by examiner

EASY-TO-ASSEMBLE TRAMPOLINE

TECHNICAL FIELD

The invention relates to a trampoline for sporting and/or recreational use, in particular, to an easy-to-assemble trampoline.

BACKGROUND

At present, the main trampoline producers in the world are mainly concentrated in China, the United States, Germany and Japan.

The basic structure of the trampoline includes a flexible mat, a frame, multiple flexible rods(having top end and bottom end), multiple supporting legs, a protective net and multiple supporting rods. The top end of the flexible rod is arranged around the flexible mat, and the bottom end of the flexible rod is retained in the frame, so that the flexible mat is set up above the frame. The frame is erected on the ground with the supporting legs. The protective net is arranged at the periphery of the flexible mat and extended above it to form a closed or semi-closed bouncing space. The protective net protects the users who move on the flexible mat from falling off it. The supporting rods are arranged around the flexible mat to support and open the protective net.

Trampoline exercise is a healthy and interesting entertainment. Studies have shown that trampoline exercise can not only exercise the body and strengthen muscle, but also help people develop a sense of balance and improve sports skills. With the development of technology, trampoline is entering people's life more and more. At the same time, the defects of traditional trampoline are also exposed, such as:

1. The bending stiffness of the flexible rod of the traditional trampoline is 1200 N/m-3000 N/m. It takes a lot of effort to install the flexible rod, so it is difficult for the general public to install it.

The installation structure of the top end and bottom end of the flexible rod is complex, which can not play an essential auxiliary role in the installation of the flexible rod.

After the installation of trampoline, the elasticity of flexible mat can not be adjusted, which can not meet the needs of different user.

The trampoline structure is not strong enough, it is easy to collapse and damage.

Therefore, it is urgent to improve the structure of trampoline in order to overcome the defects of the prior art.

SUMMARY

In order to overcome the shortcomings of the prior art, the present invention provides an easy-to-assemble trampoline, the installation structure of flexible rod is improved, so that the installation of trampoline is labor-saving and convenient, and the general public can install it by themselves. After the installation of trampoline, the elastic force of flexible mat can be adjusted to meet the needs of different people and increase the bouncing comfort. The safety of trampoline is greatly improved.

The technical proposals of the present invention are as follows:

An easy-to-assemble trampoline includes a flexible mat, a frame and a plurality of resiliently flexible rods, its top ends of the flexible rods are arranged at its periphery or at its bottom of the flexible mat, and bottom ends of the flexible rods are retained on the frame, so that the flexible mat is set up above the frame.

The top ends of the flexible rods are fixedly mounted at its periphery or bottom of the flexible mat by a buckle structure; the buckle structure includes a an mounting member, a flexible belt and at least one clamping member; one end of the belt is fixed on the flexible mat, the clamping member is fixed on the belt, and the mounting member is provided with a through hole; the belt can pass through the through hole, and the clamping member holds the belt at its outlet of the through hole so that the belt can not be pulled back from the through hole; therefore the top end of the flexible rod is fixedly contained in the mounting member.

The bottom of the mounting member is provided with an receiving groove, and the top end of the flexible rod is fixedly contained in the receiving groove.

The mounting member has a pipe part and an expanded head arranged at the top of the pipe part; the top of the flexible rod is inserted into and fixed with the pipe part; and the head is provided with the through hole.

The clamping member has a short edge and a long edge, its length of the short edge is less than its width of the through hole, and its length of the long edge is larger than its width of the through hole, so that the clamping member can pass through the through hole and be stuck at its outlet of the through hole along its long edge.

The flexible rod is a straight bar with a bending stiffness of 3000 N/m~10000 N/m, the top end of the flexible rod is deflected 10-290 mm from the natural straightening state to the center of the flexible mat, so that the flexible rod is bent and installed at its periphery or at its bottom of the flexible mat to support and tension the flexible mat.

Its diameter of the flexible rod is 0.5-3 cm, and its length of the flexible rod is 0.3-1.5 m.

The flexible rod is made from alloy aluminum.

The flexible pad has a length or width of 120 feet.

Its bottom end of the flexible rod is fixed and retained in the frame through an installation structure.

The installation structure includes a pair of upper inserting hole on the upper side of the frame and a lower inserting hole on the lower side of the frame, each pair of the upper inserting hole and the lower inserting hole are staggered settings; the flexible rod is inserted into a pair of the upper inserting hole and the lower inserting hole.

The installation structure also has a first sleeve corresponding to each pair of the upper inserting hole and the lower inserting hole, the first sleeve is inserted into a pair of the upper inserting hole and the lower inserting hole, and the bottom end of the flexible rod is inserted into the first sleeve.

Its hole diameter of the lower inserting hole is larger than the diameter of the bottom end of the first sleeve and less than the diameter of the main body of the first sleeve, thereby preventing the first sleeve from falling off the lower inserting hole.

The installation structure also has an elastic part, the elastic part is inserted between the upper inserting hole and the flexible rod, thereby adjusting the position of the flexible rod in the frame.

The upper inserting hole is arranged as an elliptical hole, and its two ends of the elliptical hole, named as A end and B end, respectively, are located on inside and outside of the upper side of the frame respectively; the elastic part is inserted into the A end or the B end, thereby adjusting the position of the flexible rod.

The frame is a circle connected at the beginnings and tails of several arc-shaped steel pipes, a joint of the adjacent arc-shaped steel pipes is respectively provided with a first socket tube and a first insert joint which are matched; the socket tube is inserted into the first insert joint and is fixedly connected therein through a nail pin.

The trampoline also includes a plurality of supporting structures, which are supported below the frame; each of the supporting structures is provided with a horizontal rod, a first vertical rod and a second vertical rod which are arranged at two ends of the horizontal rod, and a third vertical rod arranged in the middle of the horizontal rod; the first vertical rod and the second vertical rod are respectively inclined in the central direction of the flexible mat, and the top of the first vertical rod and top of the second vertical rod are reversely bent, the frame is provided with a matching cylinder matched with the top of the first vertical rod and the top of the second vertical rod.

The frame is provided with a second plug-in cylinder second socket, and the top of the third vertical rod is inserted into the second socket.

The trampoline also includes several supporting rods evenly distributed around the flexible mat; the first vertical rod is welded with a second sleeve, and its bottom end of each of the supporting rods is inserted into the second sleeve; its outlet of the second sleeve is flat, and the shape and size of its bottom end of each of the supporting rods is matched with its outlet of the second sleeve; the bottom of the second sleeve is arranged as a cylinder, and its diameter of the cylinder is slightly smaller than the diameter of its outlet.

The supporting rod is a large arc-shaped rod joined by two small arc steel pipe; the joint of the two small arc-shaped steel pipe is also provided with a matching plug-in cylinder and a plug-in connector respectively, and the plug-in connector is inserted into the plug-in cylinder, and the two are fixed and connected by a nail pin.

The trampoline also includes a protective net, its bottom of the protective net is arranged around the flexible mat and extends upward, its top of the protective net is supported by a plurality of supporting rods disposed around the flexible mat, forming a closed or unclosed space for bouncing.

Its top of the supporting rod is provided with a hole, its upper end of the protective net is provided with a plurality of upper hooks, and the hook is inserted into the hole; the buckle structure is provided with lower hooks; and the lower hooks hook the lower end of the protective net.

The buckle structure is provided with a mounting member, the mounting member has a pipe part and an enlarged head part arranged at the top end of the pipe part, the lower hook is arranged on the pipe part, and the lower hook is arranged toward the center of the flexible mat.

Its top of the protective net is also provided with a basketball frame; the basketball frame is fixed on one of the supporting rods; the protective net is provided with a zipper door; and the frame is also provided with a ladder.

Its bottom of the protective net is connected with the periphery or bottom of the flexible mat by zipper.

The beneficial effects of the invention are as follows: the buckle structure connects the flexible rod and the flexible pad, the installation of trampoline can be easily realized, the installation safety can be improved, and the elasticity of the trampoline can be adjusted.

The mounting structure includes the first sleeve, the first sleeve is inserted into the frame and used for receiving the bottom end of the flexible rod, so as to facilitate the installation of the flexible rod, and the frame structure is simplified and the production is convenient. An elastic member is also arranged in the frame, which adjusts the position of the flexible rod inserted into the frame, thereby adjusting the tension and elasticity of the flexible pad to meet the needs of different users and improve the bounce comfort of the flexible pad.

The supporting structure increases the stability of the trampoline and improves the safety performance of the trampoline.

The bending stiffness of the flexible rod is 3000 N/m–10000 N/m. Although the bending stiffness is high, when installing, it only needs to deflect 10-200 mm to the center of the flexible pad. The installation is labor-saving. Ordinary consumers can install it themselves, it reduces the difficulty of trampoline installation and improves the safety of the installation. The bending stiffness of the flexible rod is 3000 N/m–10000 N/m, which is not easy to fatigue and has good elastic recovery ability. It can keep the flexible pad in the tension state and increase the balance performance of the trampoline.

By setting the upper hook and the lower hook to hook the upper part and lower part of the protective net respectively, the protective net is fixed and supported around the flexible pad and enclosed into a closed or unclosed space, which makes the installation and disassembly of the protective net very convenient.

DETAILED DESCRIPTION OF EMBODIMENTS

The followings will further descript the present invention with the embodiments, which are the preferable embodiments in the present invention.

Figure 1:
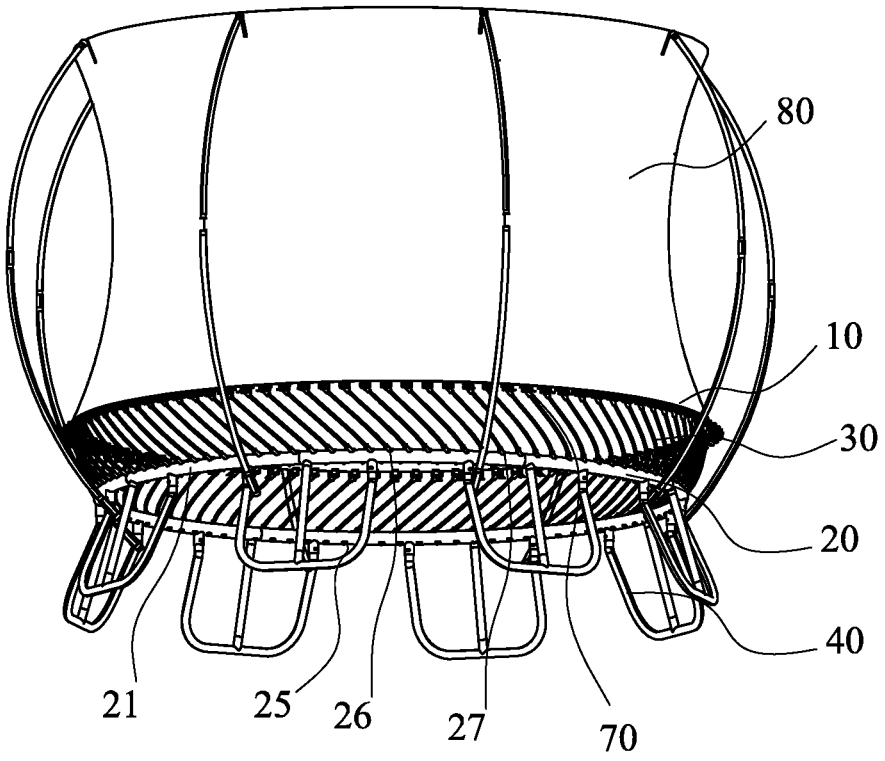
FIG. 1 is a perspective view of the trampoline in the present invention.

Referring to FIG. 1, the popular trampoline usually includes a flexible mat 10 and a frame 20, and a plurarty of resiliently flexible rod 30 with top end and bottom, end. Its top end 31 of the flexible rod 30 is installed at its periphery or at its bottom of the flexible mat 10, and its bottom end of the flexible rod 30 is retained in the frame 20 so that the flexible mat 10 is set up above the frame 20. At the pressure of the flexible mat 10, the flexible rod 30 is generally bent and tensioned the flexible mat 10. The user is able to bounce, play, and perform on the flexible mat 10. The flexible rod 30 is preferably made from alloy aluminum, glass fiber, or carbon fiber.

The flexible mat 10 is preferably round, or it may be any other shape, such as a square, a pentagonal, a hexagonal, an oval, etc. The frame 20 is a circle connected at the beginnings and tails of several arc-shaped steel pipes 21, the joint of the adjacent arc-shaped steel pipes 21 is respectively provided with a first plug-in cylinder and a first plug-in connector which are matched; the first plug-in connector is inserted into the first plug-in cylinder and is fixedly connected therein through a nail pin.

The frame 20 may also be placed on the ground, it is preferably placed on the supporting legs 40.

In order to support the flexible pad 10 and the user, the flexible rod 30 generally needs to have a certain bending force. When the flexible rod 30 is installed, its bottom end of the flexible rod 30 is usually fixed in the frame 20, and then its top end of the flexible rod 30 is deflected from the natural straightening state toward the center of the flexible pad 10, so that the flexible rod 30 supports and tentioned the flexible pad 10 to meet the elasticity required to bounce.

In the prior art, the bending stiffness of the flexible rod 30 is generally less than 3000 N/m. This requires that its top end of the flexible rod 30, which has not been connected to the edge of the flexible mat 10, deflect 300-450 mm from the natural straightening state to the center of the flexible mat 30 in order to support the flexible mat 30 and make the elasticity of the flexible mat 30 meet the requirements of the trampoline. The bending stiffness of flexible rod 30 in the prior art is too low, resulting in poor elastic recovery ability and easy bending. After the trampoline is used for a period of time, the flexible rod 30 cannot be restored to the original position so that the flexible mat 10 no longer maintains the tentioned state, the structure is relaxed, and the elasticity decreases. In addition, when the bending stiffness of the flexible rod 30 is less than 3000 N/m, the maximum size of the flexible mat 10 can only be 13 feet. Otherwise, the elasticity of the flexible mat 10 cannot meet the requirements.

The applicant has found that the bending stiffness of the flexible rod 30 can overcome the above-mentioned defects when the flexible rod 30 is a straight rod with bending rigidity of 3000 N/m–10000 N/m, the bottom end of the flexible rod 30 is retained in the frame, and the top end of the flexible rod deflects 10-200 mm from the natural straightening state to the center of the flexible mat, so that the flexible rod is bent and installed at the periphery or at the bottom of the flexible mat 10 to support and tighten the flexible mat 10. When the bending stiffness of the flexible rod is 3000 N/m~10000 N/m, the elastic restoring force of the flexible rod increases and is not easy to fatigue and deform. Although the bending stiffness of the flexible rod increases, the distance of deflection towards the center of the flexible mat is reduced, which makes the installation of the flexible rod easier.

At present, the material of the flexible rod in the market is glass fiber or carbon. The glass fiber has good corrosion resistance, insulating property, heat-insulating property and high strength etc. However, the hardness of the glass fiber is high, combined with its inherent brittleness, the glass fiber has the defects of not bending resistance, poor abrasion resistance, poor flexibility and the like, the long-term repeated use of the glass fiber rod and the use of the glass fiber rod in the low-temperature state are easy to crack, the original elasticity is lost, Sometimes it breaks, causing trampoline damage, and there are safety risks. In addition, according to the list of carcinogens in the list of carcinogens published by the World Health Organization International Cancer Research Agency on 27 Oct. 2017, it is an unsafe material.

Preferably, the material of the flexible rod 30 according to the present invention is an aluminum alloy rod. Aluminum alloy is light in material, the surface is oxidized, wind resistance and compressive capacity are stronger than that of fiberglass, and it also has good strength, toughness, fatigue resistance and plasticity, not easy to break. Even if the pressure exceeds its upper limit, the aluminum alloy rod does not break, but increases the curvature. It will not cause trampoline damage and improve the safety of trampoline.

Preferably, the diameter of the flexible rod is 0.5-3.0 cm.

Preferably, the length of the flexible rod is 0.3-1.5 m.

When the stiffness of the flexible rod is 3000 N/m~10000 N/m, the diameter of the flexible mat is 11-20 feet.

Figure 2:
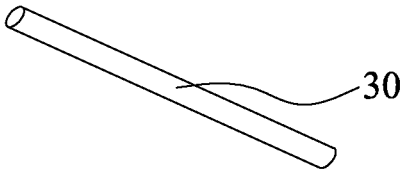
FIG. 2 is a perspective view of the flexible rod 30 in the present invention.

Referring to FIG. 2, its bottom end of the flexible rod 30 is fixed and retained in the frame 20 through an installation structure. The installation structure includes an upper inserting hole 24 provided on an upper side of the frame 20 and a lower inserting hole 25 provided at a lower side of the frame 20. And each pair of the upper inserting hole 24 and the lower inserting hole 25 is disposed in a staggered manner. The bottom end 31 of the flexible rod 30 is inserted obliquely into the upper inserting hole 24 and the lower inserting hole 25.

The installation structure also includes a first sleeve 26 corresponding to each pair of the upper inserting hole 24 and the lower inserting hole 25. The first sleeve 26 is inserted into the upper inserting hole 24 and the lower inserting hole 25. The bottom end of the flexible rod 30 is inserted into the first sleeve 26.

Figure 3:
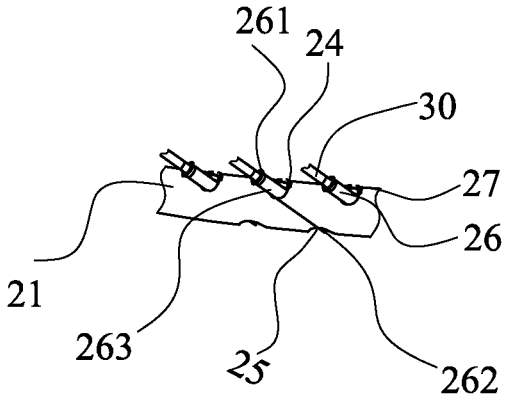
FIG. 3 is a perspective view of the installation structure of the trampoline in the present invention.
Figure 4:
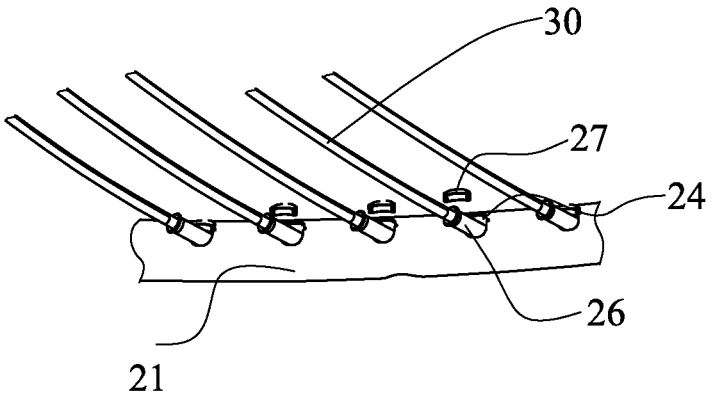
FIG. 4 is a decomposition view of the installation structure of the trampoline in the present invention.
Figure 5:
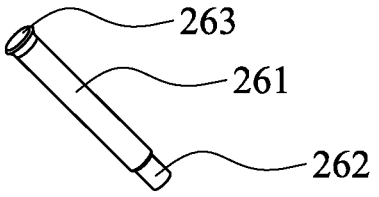
FIG. 5 is a perspective view of the first sleeve in the present invention.

Referring to FIGS. 3-5, in order to prevent the first sleeve 26 from falling off from the lower inserting hole 25, its diameter of the bottom end 262 of the first sleeve 26 is less than its diameter of its main part 261 of the first sleeve 26. In particular, the aperture of the lower inserting hole 25 is larger than the diameter of the bottom end 262 and smaller than the diameter of the main body 261, thereby preventing the first sleeve 26 from falling off the lower inserting hole 25.

Further, its top 263 of the first sleeve 26 is provided with a gradually broaden outlet in the direction so as to facilitate the insertion of the bottom end of the flexible rod 30.

When the bottom end 32 of the flexible rod 30 is installed, the first sleeve 26 is first inserted into a pair of upper inserting hole 24 and the lower inserting hole 25, and then the bottom end 32 of the flexible rod 30 is inserted directly into the first sleeve 26. Or the bottom end 32 of the flexible rod 30 can be inserted directly into the first sleeve 26, and then the two are inserted into a pair of upper inserting hole 24 and the lower inserting hole 25 at the same time, and the installation is simple and convenient.

It should be understood that when the bottom end of the flexible rod 30 and the first sleeve 26 are inserted into the lower inserting hole 25, the bottom end of the flexible rod 30 is fixed in the frame 20. When the top end of the flexible rod 30 is installed around the flexible mat 10, the installing position of the top end of the flexible rod 30 remains unchanged, and the tension and elasticity of the flexible mat 10 are constant.

Figure 7:
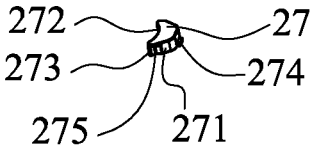
FIG. 7 is a perspective view of the elastic member 27 in the present invention.

Referring to FIG. 3, FIG. 5 and FIG. 7, an elastic member 27 is also provided at the upper inserting hole 24. The elastic member 27 is inserted between its hole wall of the upper inserting hole 24 and the flexible rod 30 to adjust the position of the flexible rod 30. Preferably, the upper inserting hole 24 is arranged as an elliptical hole, and the two ends of the elliptical hole are recorded as the A position and the B position, respectively, located on the inside and outside of the upper side of the frame 20. The elastic member 27 is inserted into the A position or the B position, so that the position of the flexible rod 30 in the frame 20 is adjusted, and the tension and the elastic force of the elastic member 27 are adjusted. Concretely, when the bottom end of the flexible rod 30 and the first sleeve 26 pass through the upper inserting hole 24 and insert the lower inserting hole 25. The elastic member 27 is inserted into the A position, that is, the upper inserting hole 24 is close to the inner side of the upper side of the frame 20, and the flexible rod 30 and the first sleeve 26 are extruded to a B position. At this time, the flexible rod 30 has a greater tensile force on the flexible mat 10 and the elastic flexible mat 30 has higher elasticity. When the elastic member 27 is inserted into the B position, that is, the upper inserting hole 24 is close to the outside of the frame 20, the flexible rod 30 and the sleeve 26 are squeezed to the A position. The tension of the flexible mat 10 is smaller, and the elasticity of the flexible mat 10 is reducer.

Figure 6:
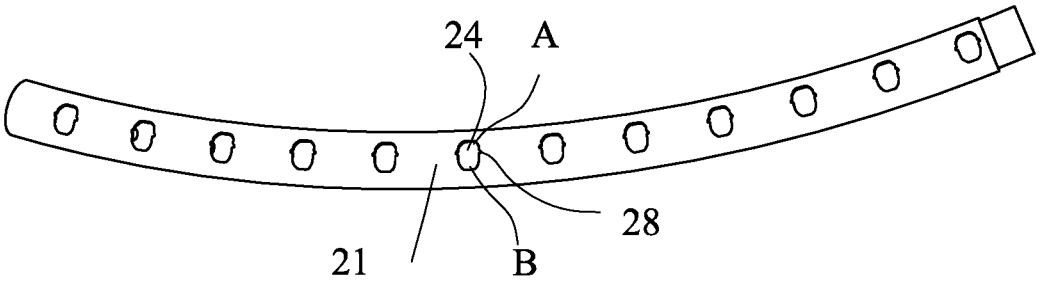
FIG. 6 is perspective view of the arc-shaped steel pipe 21 in the present invention.

Preferably, referring to FIG. 6, its middle position of the hole wall of the upper hole 24 is symmetrically dug with two limiting grooves 28. Referring to FIG. 6, its side of the elastic member 27 close to the first sleeve 26 is the inner side, its side of the elastic member 27 close to the hole wall is the outer side 272, the inner side 271 and the outer side 272 are arranged as arc surfaces, and the intersection of the two arc surfaces is provided with clamping block 273, the clamping block 273 and the limit groove 28 are match each other and can hold each other.

Preferably, the intersection of the clamping block 273 and the outer side 272 is provided with an upper convex part 270. Its bottom of the outer side 272 of the elastic member 27 is provided with a lower convex part 275. The elastic member 27 is inserted into the upper inserting hole 24, and the upper convex part 274 and the lower convex part 275 are respectively holds the periphery of the hole wall of the upper inserting hole 24 from the upper direction and the lower direction, thereby preventing it falling off from the upper inserting hole 24.

Figure 8:
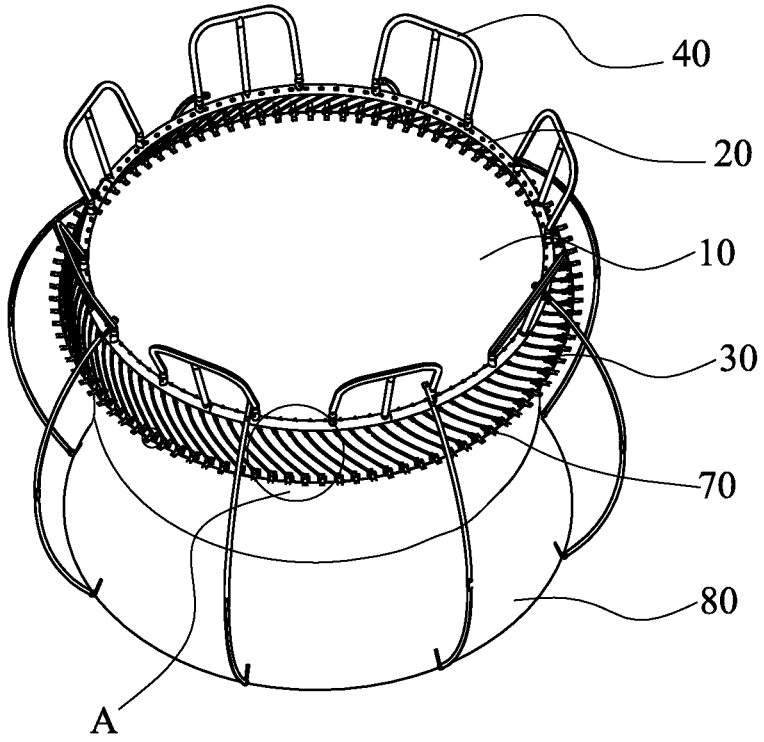
FIG. 8 is another perspective view of the trampoline in the present invention.
Figure 12:
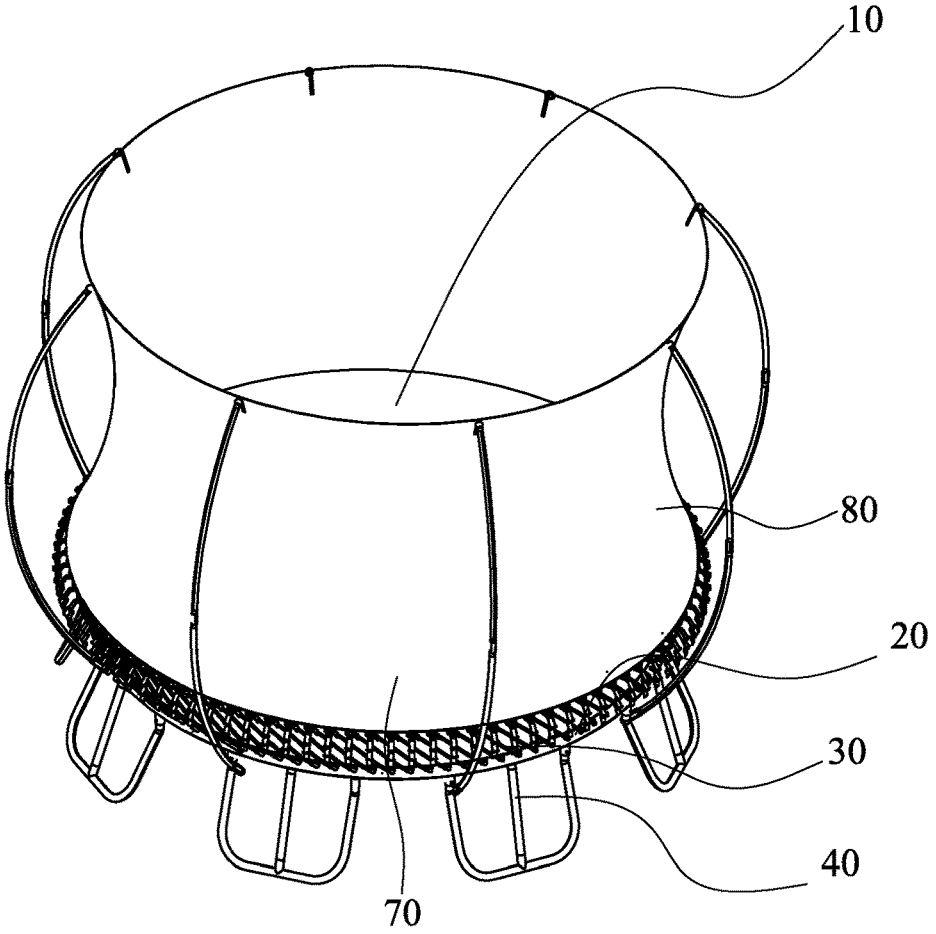
FIG. 12 is another perspective view of the trampoline in the present invention.

Preferably, referring to FIG. 1, FIG. 8 and FIG. 12, in order to facilitate the installation of the top end of the flexible rod 30, a plurality of buckle structures 70 are arranged at its periphery or at its bottom of the flexible mat 10, the buckle structures 70 corresponds to the flexible rods 30, and the top end 31 of the flexible rod 30 is detachably installed in a predetermined position at its periphery or at its bottom of the flexible mat 10 in a labor-saving and convenient manner. Referring to FIG. 3, the buckle structure includes a mounting member 71, a flexible belt 72 and at least one clamping member 73. One end of the belt 72 is fixed on its bottom of the flexible mat 10, the clamping member 73 is fixed on the belt 72, and the mounting member 71 is provided with a through hole 713; the belt 72 can pass through the through hole 713, and the clamping member 72 holds the belt 72 at its outlet of the through hole 713 so that the belt 72 can not be pulled back from the through hole 713; therefore the top end of the flexible rod 30 is fixedly contained in the mounting member 71.

Figure 10:
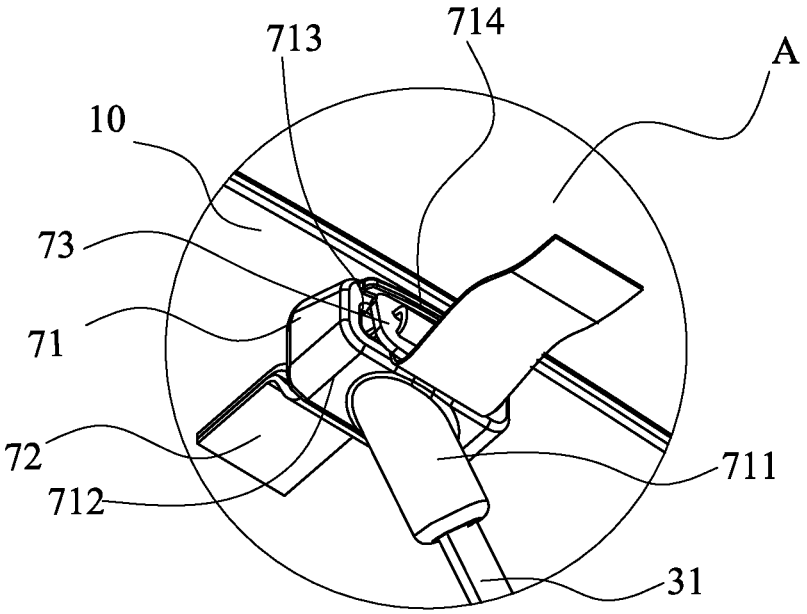
FIG. 10 is an enlarged view of the A of FIG. 8, which shows another perspective view of the buckle structure in the present invention.

Preferably, referring to FIG. 10, in one embodiment of the present invention, the bottom of the mounting member 71 is provided with a receiving groove(not shown)in which the top 31 of the flexible rod 30 is fixedly disposed. Preferably, the receiving groove is arranged in an extension direction of the top end 31 of the flexible rod 30 so as to facilitate the insertion of the top 31 of the flexible rod 30. In the embodiment shown in FIG. 10, the mounting member 71 is similar to a cubic shape. It should be understood that the shape of the mounting member 71 is not limited to the shape shown in FIG. 3, but it may also be spherical, polyhedral or any other shape. The present invention is not specifically limited to the shape of the mounting member 71, and any change in the external shape of the mounting member 71, without departing from the basic concept of the present invention, should be regarded in the scope of protection as defined in the present invention.

Figure 11:
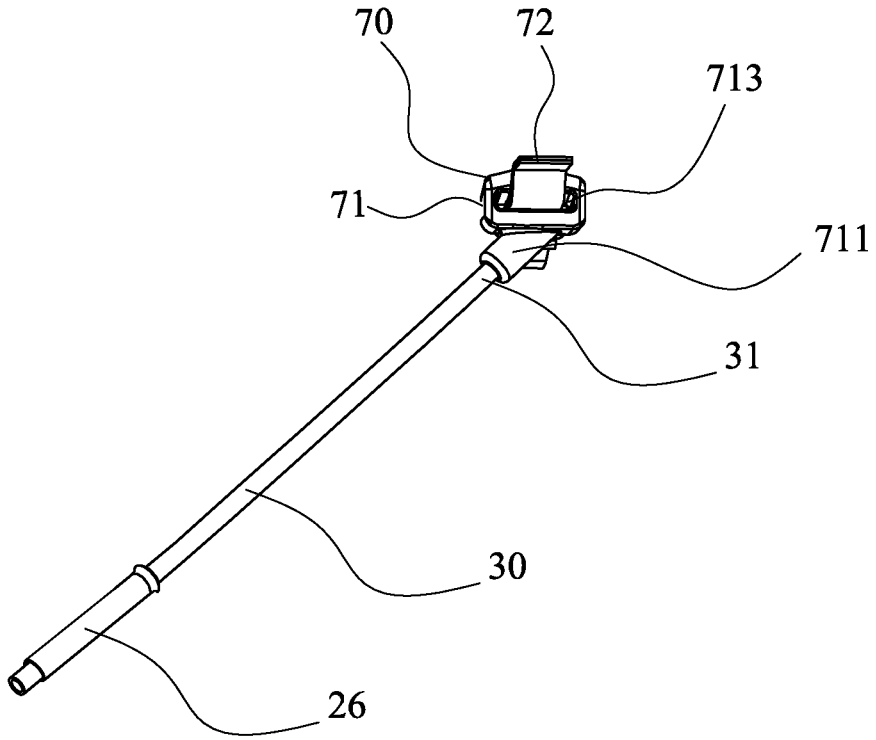
FIG. 11 is a perspective view of the flexible rod is used in conjunction with the buckle structure and the first sleeve.

Preferably, referring to FIG. 10, FIG. 11 and FIG. 12, the mounting member 71 has a pipe part 711 and an expanded head 712 arranged at the top of the pipe part 711. The top end 31 of the flexible rod 30 is inserted into and fixed with the pipe part 711. The pipe part 711 is arranged in an extension direction of the top end 31 of the flexible rod 30 so as to facilitate the insertion of the top end 31 of the flexible rod 30. The side of the expanded head 712 is provided with the through hole 713.

Referring to FIG. 10, the diameter of the expanded head 712 is larger than that of the pipe part 711, thereby increasing the contact area between the mounting member 71 and the flexible mat 10, and more firmly supporting the flexible mat 10.

Preferably, a baffle 714 is protruded at the expanded head 712 at the outlet of the through hole 723. The baffle 714 is able to resist the clamping member 73, thereby preventing the clamping member 73 from sliding and retracting the through hole 723.

Concretely, referring to FIG. 10, the expanded head 712 is similar to a cuboid shape, its bottom side of the expanded head 712 is integrated into the pipe part 711, the expanded head 712 is arranged with a small end and a large end along the direction of the through hole 713. The through hole 713 is arranged in a flat hole.

Preferably, the clamping member 73 is capable of passing through one side of the through-hole 713 and is fixed on the other side of the through-hole 713. In one of the embodiment of the invention, the clamping member 73 has a smaller short edge and a longer long edge. The short edge of the clamping member 73 is slightly smaller than the width of the through hole 713, and the long edge of the clamping member 73 is slightly larger than the width of the through hole 713. Such a configuration enables the clamping member 73 to pass through from one side of the through hole 713 to the other side, turn the card member 73 after passing through it, and hold it at the outlet of the through hole 713.

Figure 9:
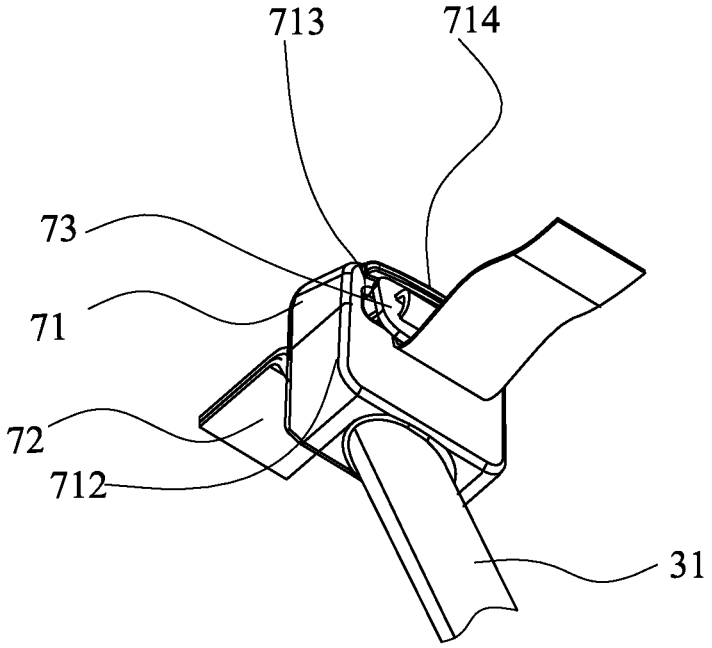
FIG. 9 is a perspective view of the buckle structure in the present invention.
Figure 13:
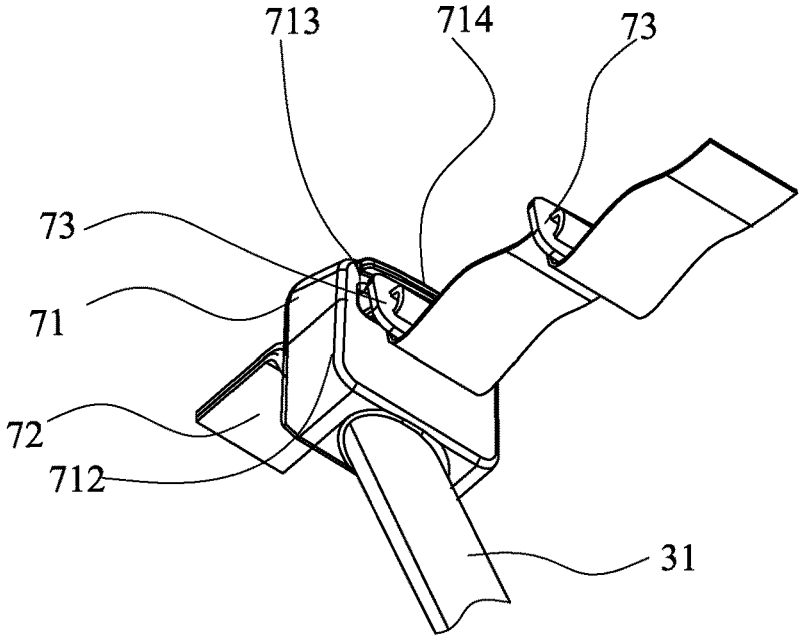
FIG. 13 is another perspective view of the buckle structure in the present invention.

It is to be understood that the clamping member 73 matches the shape of the through hole 713. For example, when the clamping member 73 is a long cylinder, the through hole 713 should also be a long cylinder; when the clamping member 73 is a long cube shape, the through hole 713 must also be a long cubic shape accordingly. Referring to FIG. 9, FIG. 10 and FIG. 13, in one of the embodiment of the invention, the clamping member 73 is provided as a thin metal piece. The through hole 713 is also arranged as a flat mouth. Preferably, the clamping member 73 of the invention is designed as a thin piece. The through hole 713 is designed as a flat hole. Preferred, the end of the clamping member 73 is provided with a hook.

After the clamping member 73 passes through the through hole 713, the clamping member 73 is stuck at the other side of the hole 713, thereby realizing the fixing of the belt 72 and preventing the belt 72 from being retracted under the action of pulling force, thereby fixing the top of the flexible rod 30 at its periphery or at its bottom of the flexible mat 10.

It should be understood that the position of the clamping member 73 on the belt 72 must meet the design purpose of "installing the top of the flexible rod 30 at its periphery or at its bottom of the flexible mat 10". Therefore, the clamping member 73 shall be installed on the belt 72 in a suitable position. The clamping member 73 is too far or too close to the flexible mat 10 to achieve the design purpose.

The belt 72 is fixed on the flexible mat 10. It should be understood that the flexible belt 72 is fixed at the flexible mat 10 in a variety of ways, for example, by welding, clamping, fastening, etc. In the preferred embodiment of the invention, the belt 72 is sewn at the bottom of the flexible mat 10.

Referring to FIG. 11, the mounting member 71 may be arranged directly at the top of the flexible rod 30. During installation, the bottom end 32 of the flexible rod 30 is first inserted into the first sleeve 26 and the frame 20, then the belt 72 is passed through the through hole 723, and the top 31 of the flexible rod 30 and the mounting member 71 are pushed to a predetermined position at its periphery or at its bottom of the flexible mat 10, the clamping member 73 is pulled out of the through hole 713, and the clamping member 73 is rotated to hold it at the outlet of the through hole 713. It is realized that the top 31 of the flexible rod 30 and the head 712 are installed at its periphery or at its bottom of the flexible mat 10.

The mounting member 72 may also be directly installed onto the belt 71. During the installation, the bottom end 32 of the flexible rod 30 is first inserted into the first sleeve 26 of the frame 20, the mounting member 72 is adjusted to the proper position of the belt 71, the top end 31 of the flexible rod 30 is inserted into the mounting groove or the tube part of the mounting member 72, pushing the top end 31 of the flexible rod 30 and the mounting member 72 to a predetermined position at its periphery or at its bottom of the flexible mat 10, pulling the clamping member 73 from the through hole 713, rotating the clamping member 73 to hold it at the through hole 713, the purpose of installing the top end 31 of the flexible rod 30 and the head 722 at its periphery or at its bottom of the flexible mat 10 is realized.

In the trampoline, a number of flexible rods 30 are evenly distributed between the frame 20 and the flexible mat 10, supporting the flexible mat 10 so that the force of the flexible mat 10 is balanced in all directions. In the process of trampoline installation, if multiple of the flexible rods 30 are installed in sequence on the flexible mat 10, the side of the flexible mat 10, where has not installed the flexible rods 30, will be suffer uneven force, resulting in the difficulty of installing the flexible rod on that side, and even affecting the forming structure of the final product. To resolve this shortcomings, referring to FIG. 12 and FIG. 13, the number of the clamping member 73 on the belt 72 of the present invention is two, and the first clamping member 73 is capable of installing the top end of the flexible rod 30 and the head 722 in a pre-installed position, for example, its periphery of the flexible mat. The second clamping member 73 is capable of installing the top end of the flexible rod 30 and the head 722 in the installing position, for example, the bottom of the flexible mat 10. During installation, the bottom end of the flexible rod 30 is first fixed to the frame 20, the belt 72 and the first clamping member 73 pass through the through hole 713 of the head 722, and the clamping member 73 is hold at the through hole 713 to fix the belt. The top end of the flexible rod 30 and the head are mounted in a pre-installed position, such as its periphery of the flexible mat. When all of the top ends of the flexible rod 30 are installed in a pre-installed position, the belt 72 is pulled sequentially to drive the second clamping member 73 to pass through the through hole 713 and hold at the outlet of the through hole 723, the flexible rod 30 is further bent, and the top of the flexible rod 30 is mounted in the mounting position, that is, the bottom of the flexible mat 10.

In general, in order to facilitate transportation, the frame 20 is a circle connected at the beginnings and tails of several segments of arc-shaped steel pipe. The joint 25 of the adjacent arc-shaped steel pipe 24 is provided with a first socket tube and a first insert joint (not shown) respectively. The first socket tube is inserted into the first insert joint, and the two are fixed and connected through the nail pin. In the structure of the trampoline, the bottom end of the flexible rod 30 is mounted on the frame 20, and the top of the flexible rod 30 is supported around the flexible mat 10. The flexible mat 10 presses the flexible rod 30 down so that it bends in the central direction of the flexible mat 10. During the installation of the trampoline, when the arc-shaped steel pipe 24 is connected to the flexible mat 10 through a plurality of flexible rods 30, the flexible rod 30 bends towards the center direction of the flexible mat 10 under the pressure, and the flexible rod 30 pulls the arc-shaped steel pipe 24 upward towards the center direction of the flexible mat 10 so that the middle of each section of the arc-shaped steel pipe 24 is high and the sides of the arc-shaped steel pipe are low, the adjacent arc-shaped steel pipe 24 falls off or collapses from the joint and destroys the stability of the frame 20.

Figure 14:
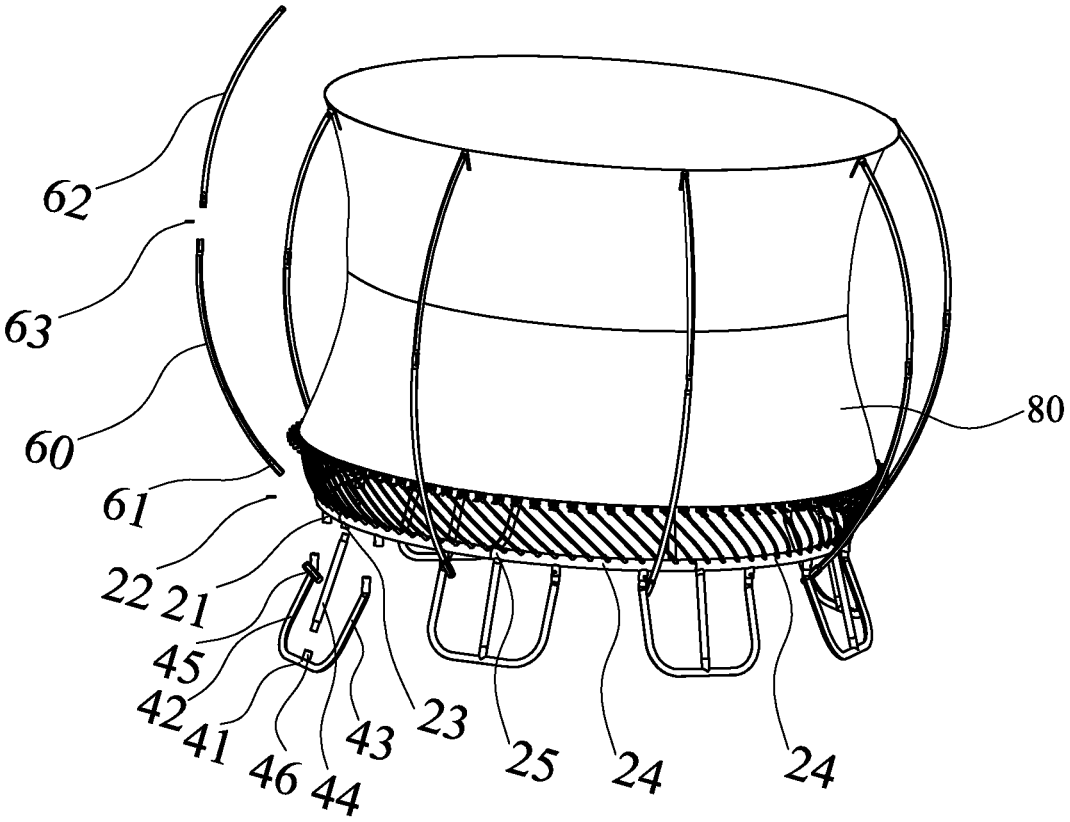
FIG. 14 is a decomposition view of the trampoline in the present invention.
Figure 15:
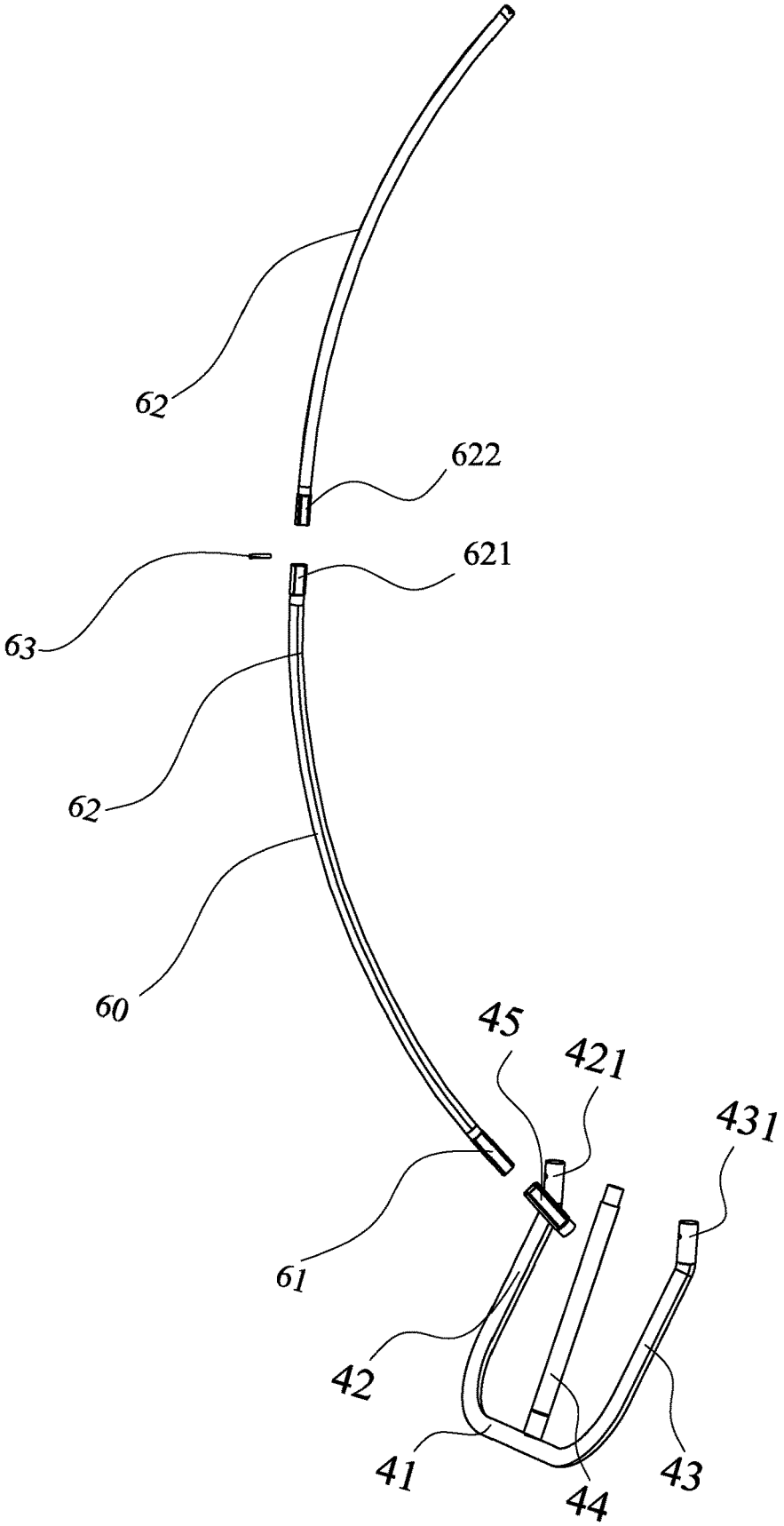
FIG. 15 is a perspective view of the leg structure 40 and the supporting rod 60 of the trampoline in the present invention.

Referring to FIG. 14 and FIG. 15, the trampoline also includes supporting structures 40, a plurality of which are supported below the frame 20 to remove it from the ground. The supporting structure 20 is provided with a horizontal rod 41, a first vertical rod 42 and a second vertical rod 43 which are arranged at two ends of the horizontal rod 41, and a third vertical rod 44 arranged in the middle of the horizontal rod 41; the first vertical rod 42 and the second vertical rod 43 are respectively inclined in the central direction of the flexible mat 10, and the top of the first vertical rod 41 and the second vertical rod 42 are reversely bent.

The frame 20 is provided with two matching cylinders 21 matched with its top end 421 of the first vertical rod 41 and its top end 431 of the second vertical rod 42 respectively. The installing direction of the matching cylinders 21 on the frame 20 must be in the extension direction of its top end 421 of the first vertical rod 42 and its top end 431 of the second vertical bar 43, so that the installation of the leg structure 40 can be easily realized. Further, in order to achieve a stable installation, one of the matching cylinders 21 and the top end 421 are fixed through the nail pin 22. The other of the matching cylinders 21 and the top end 431 are fixed through the nail pin 22.

After the first vertical rod 42 and the second vertical bar 43 are inserted into the matching cylinders 21, the first vertical rod 42 and the second vertical bar 43 apply to the arc-shaped steel pipe 24 a force opposite to that applied by the flexible rod 30, thereby keeping the arc-shaped steel pipe 24 in balance and preventing the arc-shaped steel pipe 24 from being high in the middle and low at both ends.

In order to more firmly support the frame 20, the joint 25 of the adjacent arc-shaped steel pipe 24 is provided with a second socket 23, which is located in an extension direction at its top end of the third vertical rod 44. The top end of the third vertical rod 44 is inserted into the second socket 23 to support the joint 25 of the arc-shaped steel pipe 24 to prevent the adjacent arc-shaped steel pipes 24 from falling off or collapsing from the joint 25.

The middle of the horizontal rod 41 is provided with a third insert cylinder 46, and the bottom end of the third vertical rod 44 is inserted into the third insert cylinder 46, thereby facilitating the disassembly and installation of the third vertical rod 44.

Referring to FIG. 14 and FIG. 15, the trampoline also includes a number of supporting rods 60 evenly distributed around the flexible mat 10. The first vertical rod 42 is welded with a second sleeve 45 at its bending position, the installing direction of the cylinder mouth 451 of the second sleeve 45 is located in the extension direction of its bottom end 61 of the supporting rod 60, and the bottom end 61 of the supporting rod 60 is inserted into the second sleeve 45. The cylinder mouth 451 of the second sleeve 45 and the bottom end 61 of the supporting rod 60 are match to each other. Preferably, the cylinder mouth 451 of the second sleeve 45 is arranged as a flat mouth. For example, the cylinder mouth 451 of the second sleeve 45 is an elliptical flat mouth, and the bottom end 61 of the supporting rod 60 is also elliptical. The cylinder mouth 451 of the second sleeve 45 is long. The square flat port and the bottom end 61 of the support bar 60 are also rectangular. The flat mouth can prevent the supporting rod 60 from rotating, thereby increasing the stability of the supporting rod 60.

Figure 16:
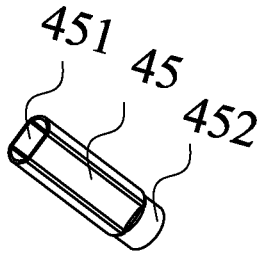
FIG. 16 is a perspective view of the second sleeve in the present invention.

Further, referring to FIG. 16, the bottom of the second sleeve 45 is provided as a cylinder 452 having a diameter slightly smaller than the diameter of the cylinder mouth 451. After the bottom end 61 of the supporting rod 60 is inserted into the cylinder mouth 451, it is also possible to squeeze into the cylinder 452 under the action of pressure. Since the diameter of the cylinder 452 is slightly smaller than the diameter of the bottom end 61, the bottom end 61 will be tightly wrapped and the binding force of the two is increased, so that the bottom end 61 cannot be removed from the second sleeve 45, thereby further increasing the mounting stability of the supporting rod 60.

Preferably, the supporting rod 60 is a large arc-shaped rod joined by two small arc-shaped steel pipe 62; the joint of the two small arc-shaped steel pipe 62 is also provided with a matching plug-in cylinder 621 and a plug-in connector 622 respectively, and the plug-in connector 622 is inserted into the plug-in cylinder 621, and the two are fixed and connected by the nail pin. The two small arc-shaped steel pipe 62 is spliced into a large arc-shaped rod, which is convenient to transport the supporting rod 60. The two arc-shaped steel pipes are connected by plug-in manner, and with the nail pin 63 fixed connection, which is easy to install.

Preferably, the structure of the plug-in cylinder 621 is the same as that of the second sleeve 45. The structure of the plug-in connector 622 is the same as that of the bottom end 61 of the supporting rod 60, which is not repeated herein.

Figure 17:
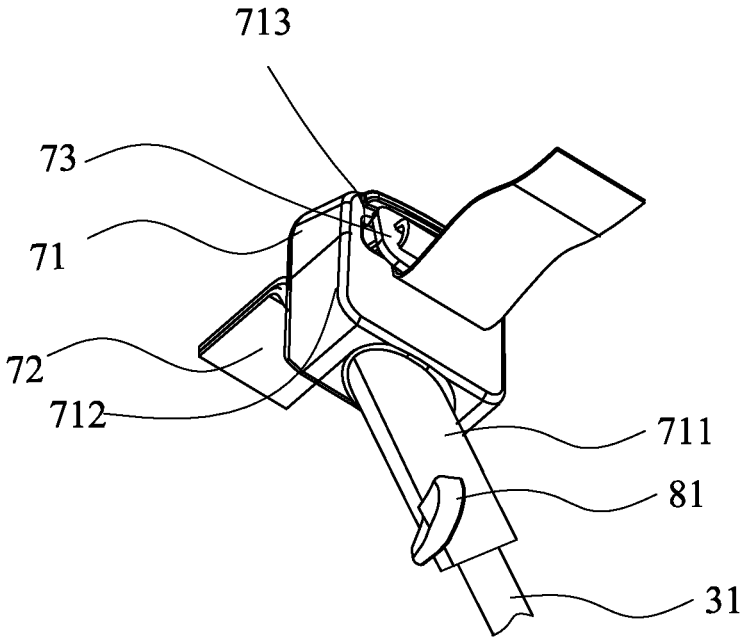
FIG. 17 is another perspective view of the buckle structure in the present invention.

Referring to FIG. 17, the trampoline also includes a protective net 80, its bottom of the protective net 80 is arranged around the flexible mat 10 and extends upward, its top of the protective net 80 is supported by the supporting rods 60 disposed around the periphery of the flexible mat 10, forming a closed or unclosed space for bouncing.

The lower end of the protective net 80 is fixed and installed around the flexible mat 10 through a plurality of lower mesh hooks 81, which are hooked through the mesh at the lower end of the protective net 80. In this way, it is very convenient to install and disassemble the protective net 80.

The lower hook 81 is arranged on the buckle structure 70, on the frame 20, or on the installation structure 70, or on the periphery of the flexible mat 10. The selection of the position of the lower hook 81 mainly considers the convenience of production and the appearance of the trampoline. Preferably, the lower hook 81 is provided on the pipe part 711 of the buckle structure 70. This design enables the lower net hook 81 to be produced using the same set of molds as the mounting member 71, it need not for additional mold and increase the production process, which brings great convenience to the production.

It should be understood that the convenience described above can also be obtained by setting the lower hook 81 on the frame 20 and the leg structure 40. But the drawback of this design is that it will increase the length of the protective net and affect the beauty of the trampoline.

Further, the lower hook 81 faces the center position of the flexible mat 10 to prevent it from hovering other objects in use or scratching the user.

Their tops of the supporting rods are provided with holes, its upper end of the protective net is provided with a plurality of upper hooks 82, the top of the support rod 60 is provided with a Jack 65, and the upper hooks 82 is inserted into the Jack 65 to support the protective net 80. The design makes the installation and disassembly of the upper part of the protective net 80 convenient.

Figure 18:
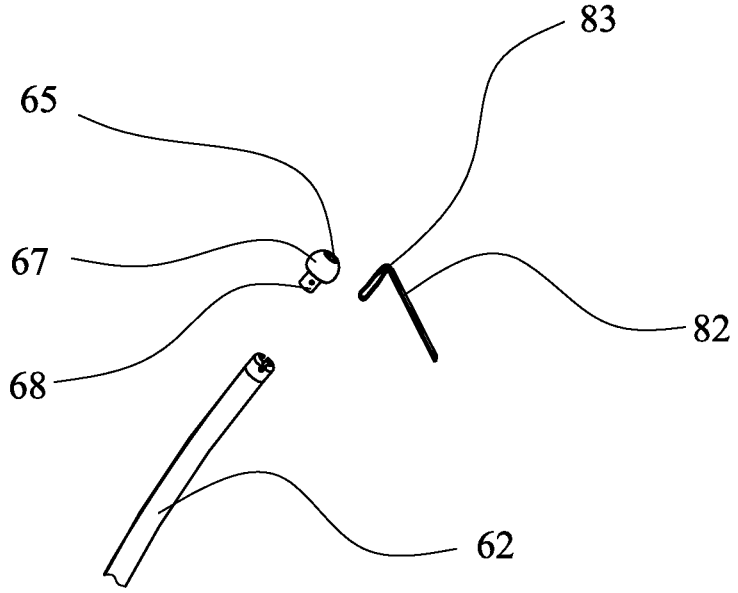
FIG. 18 is a decomposition view used in conjunction with the top of the supporting rod in the present invention.

Referring to FIG. 18, the upper hook 82 is a "7" glyph, L-shaped, U-shaped, V-shaped, and so on. It should be understood that the shape of the upper hook 82 is not limited to the listed categories.

One end of the net hook 82 is fixed and connected to the protective network 82, the other end is the inserting end 83, which is inserted into the Jack 65. The inserting end 83 is arranged as a shrapnel and is flexibly matched with the Jack 65.

The top of the supporting rod 60 is provided with an inserting number, the inserting number has a sphere 67, the bottom of the sphere 67 extends a fixing member 68, the fixing member 68 is inserted into the top of the supporting rod 60, and is fixed to the top of the supporting rod 60 by screw. The Jack 65 is arranged in the sphere 67.

Figure 19:
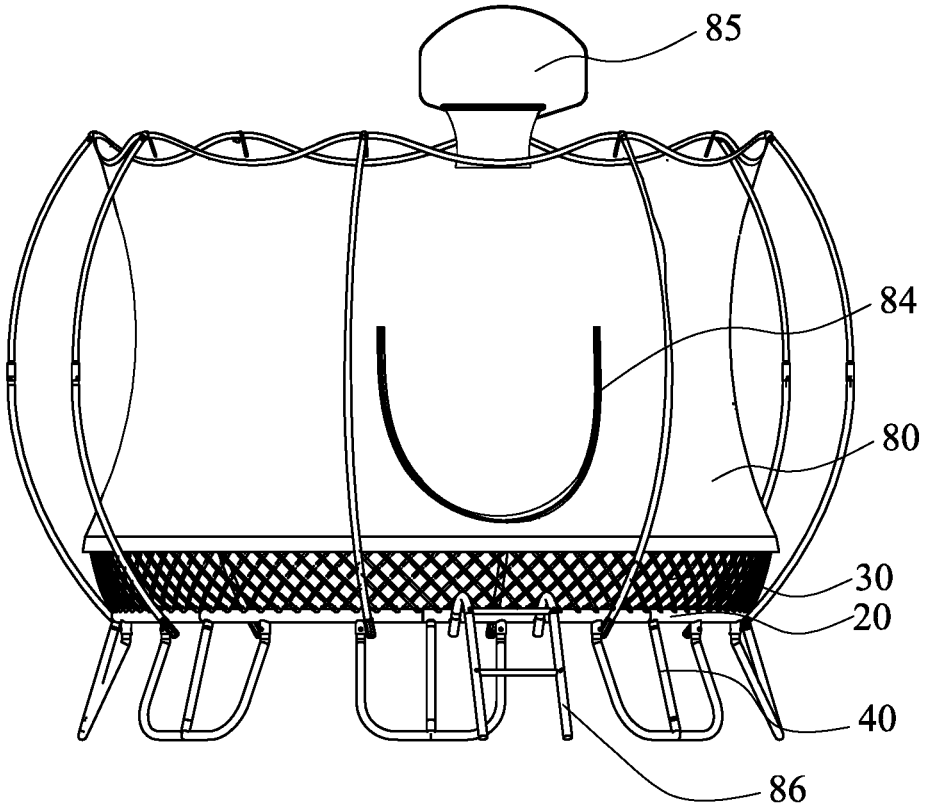
FIG. 19 is a further perspective view of the trampoline in the present invention.

Referring to FIG. 19, the top of the protective net 80 is also equipped with a basketball frame 85. The basketball frame 85 is fixed on one of the support rods 60.

The protective net 80 of the trampoline is provided with a zipper door 84. The frame 20 is also provided with a ladder 86.

Preferably, the bottom of the protective net 80 is connected by zippers to the perimeter or bottom of the flexible mat 10.

The above is a further detailed description of the invention in combination with a specific preferred embodiment, and it can not be concluded that the specific implementation of the invention is limited to these instructions. For the general technical personnel in the technical field to which the invention belongs, without being separated from the conception of the invention, the architecture form can be flexible and changeable, and a series of products can be derived. If it is just making a number of simple deductions or substitutes should be regarded as falling within the scope of patent protection determined by the claim submitted by the present invention.

What is claimed is:

1. An easy-to-assemble trampoline, comprising:

a flexible mat;

a frame; and a plurality of resiliently flexible rods with top end and bottom end, said top of said flexible rod is arranged at a periphery or at a bottom of said flexible mat, and said bottom end of said flexible rods are retained on said frame, thereby said flexible mat is installed above said frame;

wherein said top end of said flexible rods are fixedly installed at said periphery or said bottom of said flexible mat by a buckle structure; said buckle structure includes a mounting member, a flexible belt and at least one clamping member; one end of said belt is fixed on said flexible mat, said clamping member is fixed on said belt, and said mounting member is provided with a through hole; said belt can pass through said through hole, and said clamping member holds said belt at an outlet of said through hole so that said belt can not be pulled back from said through hole; said top end of said flexible rod is fixedly contained in said mounting member;

wherein said bottom end of said flexible rod is fixed and retained in said frame through an installation structure; said installation structure includes a pair of an upper inserting hole on an upper side of said frame and a lower inserting hole on a lower side of said frame, each pair of said upper inserting hole and said lower inserting hole are staggered setting; said flexible rod is inserted into a pair of said upper inserting hole and said lower inserting hole;

wherein said installation structure also has a first sleeve corresponding to each pair of said upper inserting hole and said lower inserting hole, said first sleeve is inserted into a pair of said upper inserting hole and said lower inserting hole, and said bottom end of said flexible rod is inserted into said sleeve.

2. The easy-to-assemble trampoline according to claim 1, wherein said bottom of said mounting member is provided with a receiving groove, and said top end of said flexible rod is fixed in said receiving groove.

3. The easy-to-assemble trampoline according to claim 1, wherein said mounting member has a pipe part and an expanded head arranged at a top of said pipe part; said top end of said flexible rod is inserted into said pipe part; and said head is provided with said through hole.

4. The easy-to-assemble trampoline according to claim 2, wherein said clamping member has a short edge and a long edge, a length of said short edge is less than a width of said through hole, and a length of said long edge is larger than said width of said through hole, so that said clamping member can pass through said through hole and be stuck at said through hole along its long edge.

5. The easy-to-assemble trampoline according to claim 1, wherein said flexible rod is a straight bar with bending stiffness of 3000 N/m~10000 N/m, said top end of said flexible rod is deflected 10-290 mm from said natural straightening state to said center of said flexible mat, so that said flexible rod is bent and installed at said periphery or at said bottom of said flexible mat to support and tension said flexible mat.

6. The easy-to-assemble trampoline according to claim 1, wherein a diameter of said flexible rod is 0.5-3 cm, and a length of said flexible rod is 0.3-1.5 m.

7. The easy-to-assemble trampoline according to claim 1, wherein said flexible rod is made from alloy aluminum.

8. The easy-to-assemble trampoline according to claim 1, wherein a hole diameter of said lower inserting hole is larger than that of a bottom end of said first sleeve and less than that of a main body of said first sleeve, thereby preventing said first sleeve from falling off said lower inserting hole.

9. The said easy-to-assemble trampoline according to claim 1, wherein installation structure also has an elastic part, said elastic part is inserted between said upper inserting hole and said flexible rod, thereby adjusting position of said flexible rod in said frame.

10. The easy-to-assemble trampoline according to claim 9, wherein said upper inserting hole is arranged as an elliptical hole, and two ends of said elliptical hole, named as A end and B end, respectively, are located on inside and outside of said upper side of said frame; said elastic part is inserted into said A end or said B end, thereby adjusting position of said flexible rod.

11. The easy-to-assemble trampoline according to claim 1, wherein said frame is a circle connected at beginnings and tails of several arc-shaped steel pipes, a joint of said adjacent arc-shaped steel pipes is respectively provided with a first socket tube and a first insert joint which are matched; said socket tube is inserted into said first insert joint and is fixedly connected therein through a nail pin.

12. The easy-to-assemble trampoline according to claim 1, wherein said trampoline also includes a plurality of supporting structures, which are supported below said frame; each of supporting structures is provided with a horizontal rod, a first vertical rod and a second vertical rod which are arranged at two ends of said horizontal rod, and a third vertical rod arranged in said middle of said horizontal rod; said first vertical rod and said second vertical rod are respectively inclined toward a central direction of said flexible mat, and a top of said first vertical rod and a top of said second vertical rod are reversely bent, said frame is provided with two matching cylinders matched with said top of said first vertical rod and said top of said second vertical rod.

13. The easy-to-assemble trampoline according to claim 12, wherein said frame is provided with a second socket, and a top of said third vertical rod is inserted into said second socket;

said trampoline also includes several supporting rods evenly distributed around said flexible mat; each of said first vertical rods is welded with a second sleeve, and a bottom end of each of said supporting rods is inserted into said second sleeve; an outlet of said second sleeve is flat, and said bottom end of said support rod is matched with said second sleeve; a bottom of said second sleeve is arranged as a cylinder, and a diameter of said cylinder is slightly smaller than a diameter of said outlet.

14. The easy-to-assemble trampoline according to claim 13, wherein said supporting rod is a large arc-shaped rod joined by two small arc-shaped steel pipe; a joint of said two small arc steel pipe is also provided with a matching plug-in cylinder and a plug-in connector respectively, and said plug-in connector is inserted into said plug-in cylinder.

15. The easy-to-assemble trampoline according to claim 1, wherein said trampoline also includes a protective net, a bottom of said protective net is arranged around said flexible mat and extends upward, a top of said protective net is supported by a plurality of supporting rods disposed around said flexible mat, forming a closed or unclosed space for bouncing; a bottom of said protective net is connected by zippers to a periphery or a bottom of said flexible mat.

16. The easy-to-assemble trampoline according to claim 15, wherein a top of said supporting rods are provided with holes, an upper end of said protective net is provided with a plurality of upper hooks, and said hook is inserted into said hole; said buckle structure is provided with a lower hook; and said lower hook hooks said lower end of said protective net.

17. The easy-to-assemble trampoline according to claim 16, wherein mounting member has a thin pipe part and an enlarged head part arranged at said top end of said thin pipe part, said lower hook is arranged on said thin pipe part, and said lower hook is arranged at said center of said flexible mat.

18. The easy-to-assemble trampoline according to claim 15, wherein said top of said protective net is also provided with a basketball frame; said basketball frame is fixed on one of said supporting rods; said protective net is provided with a zipper door; and said frame is also provided with a ladder.

* * * * *